US006098314A

United States Patent [19]

Pozzobon

[11] Patent Number: 6,098,314

[45] **Date of Patent: *Aug. 8, 2000**

[54] BOOT WITH AN INTERCONNECTED INNER BOOT AND CUFF STRUCTURE

[75] Inventor: Alessandro Pozzobon, Paderno Di Ponzano Veneto, Italy

[73] Assignee: Nordica S.p.A., Trevignano, Italy

[ * ] Notice: This patent issued on a continued prosecution application filed under 37 CFR 1.53(d), and is subject to the twenty year patent term provisions of 35 U.S.C. 154(a)(2).

[21] Appl. No.: 08/759,914

[22] Filed: Dec. 4, 1996

[30] Foreign Application Priority Data

Dec. 22, 1995 [IT] Italy ..... TV95U0071

[51] Int. Cl.[7] ..... A43B 23/07; A43B 5/04

[52] U.S. Cl. ..... 36/55; 36/115

[58] Field of Search ..... 36/115, 55, 117.4, 36/93, 89, 118.2, 117.2, 10

[56] References Cited

U.S. PATENT DOCUMENTS

| | | | |
|---|---|---|---|
| 3,419,974 | 1/1969 | Lange | 36/118.2 X |
| 4,126,323 | 11/1978 | Scherz | 36/115 |
| 5,171,033 | 12/1992 | Olson et al. | 36/115 X |
| 5,228,218 | 7/1993 | Bonnaventure | 36/55 X |
| 5,279,053 | 1/1994 | Pallatin et al. | 36/55 X |
| 5,499,461 | 3/1996 | Danezin et al. | 36/118.2 X |
| 5,588,228 | 12/1996 | Foscaro et al. | 36/118.2 |

FOREIGN PATENT DOCUMENTS

| | | | |
|---|---|---|---|
| 4829 | 10/1979 | European Pat. Off. | 36/55 |
| 351396 | 1/1990 | European Pat. Off. | 36/55 |

*Primary Examiner*—B. Dayoan

*Attorney, Agent, or Firm*—Guido Modiano; Albert Josif; Daniel J. O'Byrne

[57] ABSTRACT

An innerboot, particularly for skates comprising a rigid shell associated with a supporting frame for two or more in-line wheels or for an ice-skating blade. The innerboot is of the soft type and is constituted by a rigid cuff that affects at least the calf and the malleolar regions and is interposed between a padding lying inside the innerboot and an optional outer covering. The innerboot has holes for pivoting to the underlying rigid shell.

17 Claims, 2 Drawing Sheets

BOOT WITH AN INTERCONNECTED INNER BOOT AND CUFF STRUCTURE

BACKGROUND OF THE INVENTION

The present invention relates to an innerboot, particularly for skates which comprise a rigid shell associated with a supporting frame for a plurality of in-line wheels or for ice-skating blade.

Conventional skates have a rigid shell and a separate quarter made of rigid plastics, which require, in order to increase user comfort, the insertion of an innerboot made of soft material in the shell and the quarter.

In order to allow to insert the foot in the innerboot, a slit is conventionally provided on said innerboot, at the front tibial region of the instep and at the metatarsal region, the slit being adapted to form two flaps that can be spaced apart from each other for inserting the foot and can be overlapped to allow to close the shoe.

The need to have rigid elements is due to the fact that it is necessary to transmit as effectively as possible the forces from the leg to the foot and then to the wheels or blade of the skate, but this negatively affects foot comfort.

However, these conventional skates are not free from drawbacks; during sports practice, relative movements of the innerboot with respect to the quarter occur which decrease the sensitivity of the user with respect to skate control; these conventional skates also have poor lateral support, especially at the ankle region.

SUMMARY OF THE INVENTION

A principal aim of the present invention is therefore to solve the described problems, eliminating the drawbacks of the cited prior art, by providing an innerboot that allows to achieve optimum stability of the user's foot during all stages of skating, so as to allow optimum transmission of the forces from the leg to the skate.

Within the scope of this aim, an important object is to provide an innerboot that allows to specifically achieve perfect lateral support for the skate.

Another object is to provide an innerboot that has optimum insertion and comfort for the user's foot during sports practice and is reliable and safe in use.

Another object is to provide an innerboot that has low costs and can be produced with conventional machines and equipment.

This aim, these objects, and others which will become apparent hereinafter are achieved by an innerboot, particularly for skates comprising a rigid shell, characterized in that said soft innerboot comprises a rigid cuff that affects at least the calf and the malleolar regions and is interposed between an inner padding and an optional outer covering, said innerboot having means for pivoting to said shell.

BRIEF DESCRIPTION OF THE DRAWINGS

Further characteristics and advantages of the invention will become apparent from the following detailed description of a particular embodiment thereof, illustrated only by way of non-limitative example in the accompanying drawings, wherein.

DESCRIPTION OF THE PREFERRED EMBODIMENTS

Figures 1, 4:
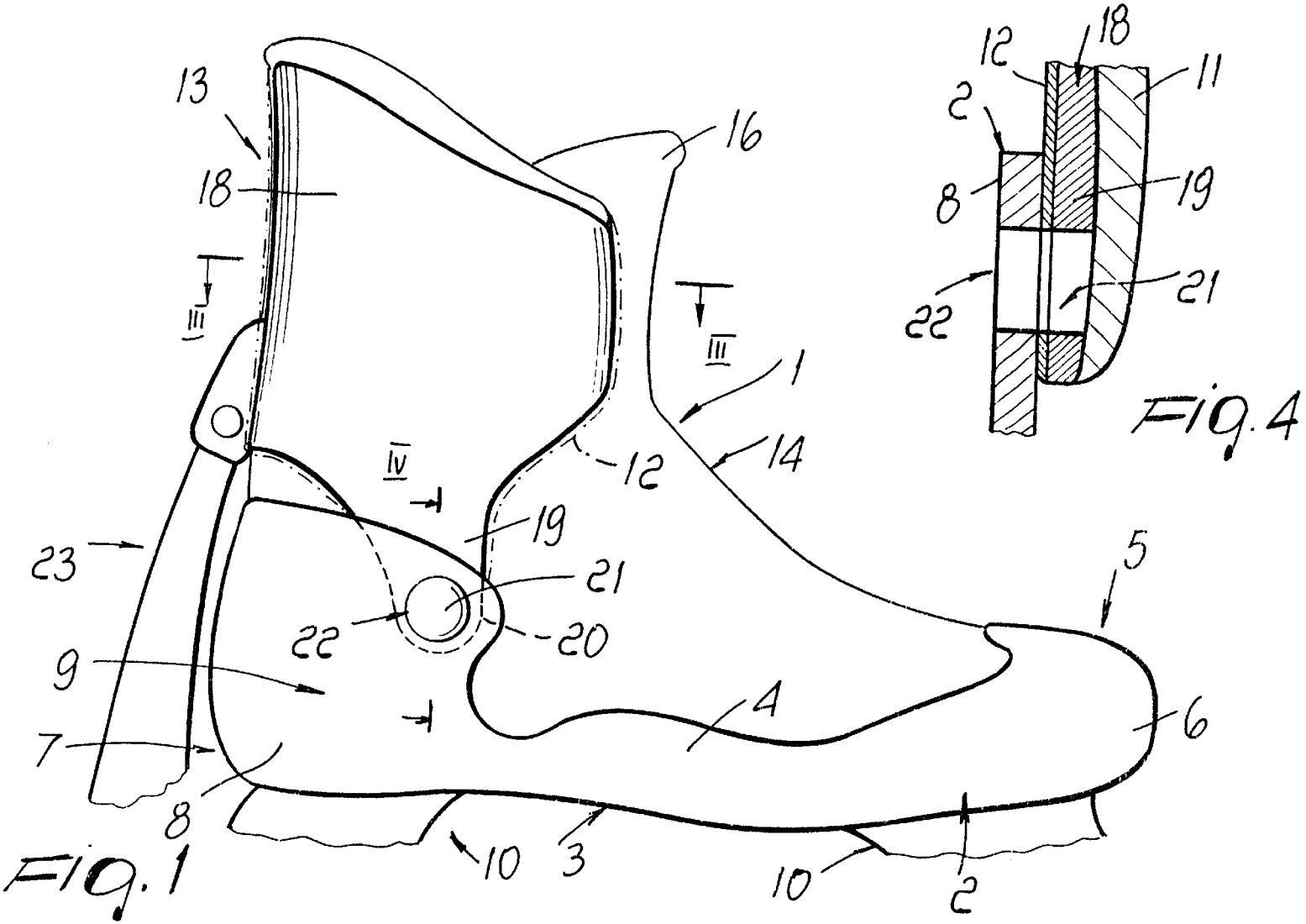
FIG. 1 is a side view of a skate according to the invention, wherein the innerboot is shown in dashed lines.
FIG. 4 is a sectional view, taken along the plane IV—IV of FIG. 1.
Figure 2:
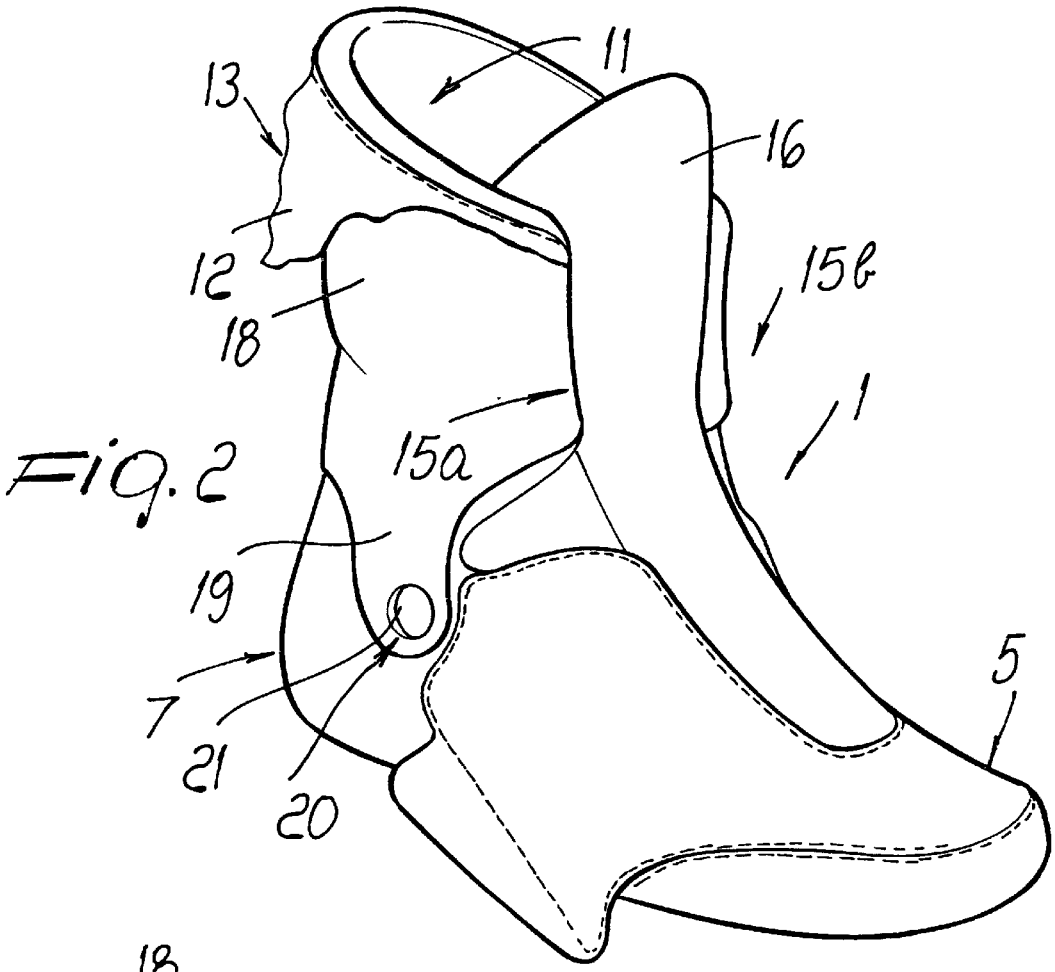
FIG. 2 is a perspective view of an innerboot.
Figure 3:
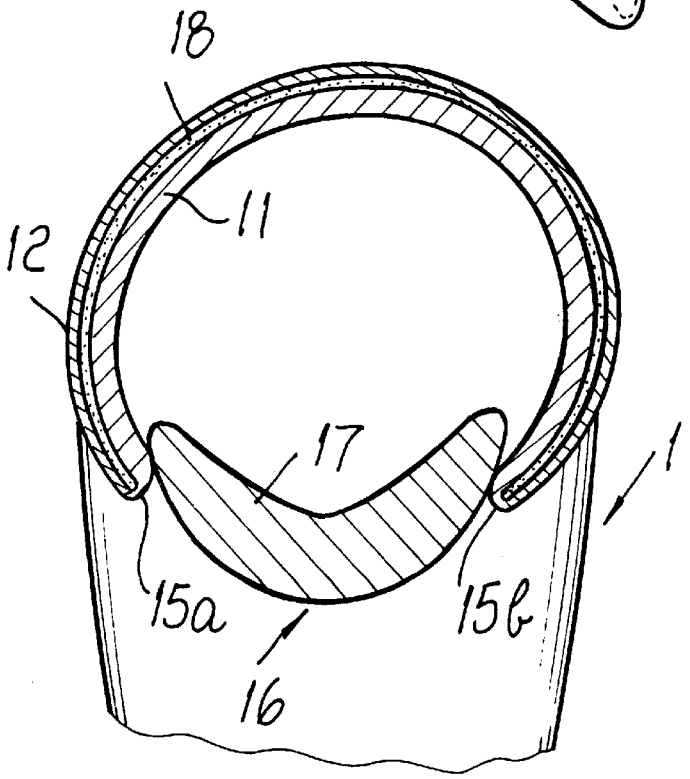
FIG. 3 is a sectional view, taken along the plane III—III of FIG. 1.

With reference to the above figures, the reference numeral 1 designates a soft innerboot, particularly for skates, having a rigid shell 2 for partially containing the innerboot 1 itself.

The shell 2 has a sole 3 from which a wall 4 for lateral containment of the innerboot 1 rises along the edge.

The shell 2 has a toe cup 6 at a first region 5 of the toe of the innerboot 1 and a heel cup 8 at a second region 7 of the heel.

The heel cup 8 rises laterally so as to partially affect a third malleolar region 9 of the user's foot.

A frame 10 can be associated below the sole 3 of the shell 2 and supports two or more in-line wheels or an ice-skating blade. The frame is illustrated only partially in FIG. 1.

At the front, at a fifth foot instep region 14 and up to the vicinity of the first toe region 5, the innerboot 1 has a slit adapted to form two flaps 15*a* and 15*b* that can be spaced apart from one another to insert the foot and can be mutually overlapped to allow to close the innerboot 1 by virtue of conventional means.

A tongue 16 is provided between the two flaps 15*a* and 15*b* and is formed by a second padding layer 17 that is preferably thicker than the first layer 11 of padding of the innerboot 1.

The innerboot 1 is inserted in the shell 2 and, in the particular illustrated embodiment, is formed by at least one inner padding 11 with which an optional outer covering 12 can be associated. A cuff 18, made of rigid material and essentially U-shaped in plan view, is located between said padding and said covering.

The cuff 18 is associated, by means of an optional seam and/or gluing and/or molding in place, outside the padding 11 at a fourth region 13 of the calves and reaches approximately the pair of flaps 15*a* and 15*b* of the innerboot 1.

The cuff 18 is laterally provided with two wings 19 facing each other, which protrude towards the sole 3 of the shell 2, and affect the third malleolar region 9.

If the innerboot 1 is provided with the optional outer covering 12, the cuff 18 is interposed in a sandwich-like manner between the padding 11 and the outer covering 12.

The two wings 19 have means 20, for pivoting to the shell 2, constituted by two first holes 21 formed at the end portion of the two wings 19, which is laterally adjacent to the upper part of the heel cup 8, when the innerboot 1 is inserted in the shell 2.

The heel cup 8 is provided with two second holes 22 having the same axis as the two first holes 21 and adapted to allow the insertion of appropriate elements, such as conventional studs or rivets, for the rotary connection of the cuff 18 to the shell 2.

Conveniently, a coupling element 23 for the pivoting of a conventional linkage-based braking system can be associated with the cuff 18 to the rear and above the second heel region 7.

Operation is as follows: in producing the innerboot, the cuff 18 is interposed between the padding 11 and the optional outer covering 12, the innerboot 1 is inserted in the shell 2, and the cuff 18 is rotatably connected to said shell 2 by using appropriate studs or rivets inserted in the two first and second holes.

It has been observed that the innerboot thus provided has achieved the intended aim and objects and is adapted to preserve the characteristics and the fundamental structural elements of the skate that is associable therewith; the rigid shell allows to keep the foot secured and to provide good stability thereof inside said shell during all stages of skating, whereas the cuff, associated with said innerboot and rotatably connected to the shell, allows to fully exploit the thrust of the user and most of all ensures the lateral rigidity that is necessary for optimum control of said skate.

The innerboot according to the invention is susceptible of numerous modifications and variations, all within the scope of the appended claims.

The materials and the dimensions constituting the individual components of the device may of course also be the most appropriate according to the specific requirements.

What is claimed is:

1. A boot structure comprising:

a soft innerboot for surrounding a user's foot and lower leg; and a rigid cuff connected to said innerboot for supporting a user's rear lower leg region and lateral lower leg regions;

said innerboot comprising:

a main portion extending for surrounding a user's sole, toes, heel, inner lateral foot, outer lateral foot, rear lower leg, inner lower leg, and outer lower leg;

a slit extending at least at the foot instep region of the innerboot for forming an inner flap and an outer flap of the innerboot adapted for being mutually spaced apart for permitting insertion and removal of a user's foot and lower leg respectively into and from the innerboot and further adapted for being mutually releasably closed for securing a user's foot and lower leg inside the innerboot; and a tongue arranged between the inner and outer flaps adapted for supporting at least a user's foot instep region when said inner and outer flaps are mutually releasably closed;

said rigid cuff being rigidly connected to an upper portion of said main portion of the innerboot and extending for supporting essentially only the inner and outer lower leg and rear lower leg regions of a user, and said rigid cuff also having a slit in correspondence with the foot instep for permitting said inner and outer flaps of the innerboot together with lateral portions of said cuff to be moved between open and closed positions; and said rigid cuff being rigidly connected to said main portion of the innerboot such that said rigid cuff together with said upper portion of said main portion of the innerboot to which said rigid cuff is connected are mutually fixed in relative position to form a single upper portion element which is rigidly pivotable with respect to a lower portion of said main portion of the innerboot; and said innerboot being made of an inner padding material and the boot structure further comprising an outer covering connected to said inner padding material and externally covering said rigid cuff thereby said rigid cuff being embedded between said upper portion of said main portion of the innerboot and said outer covering.

2. The boot structure of claim 1 further comprising a rigid lower shell arranged about the lower portion of said main portion of the innerboot for supporting a user's foot, said rigid cuff being pivoted to said rigid lower shell about an axis extending essentially through a user's malleolar regions, and said rigid lower shell being configured such that in use said rigid cuff is substantially freely pivotable rearwardly and forwardly with respect to said rigid lower shell.

3. The boot structure of claim 2 wherein said rigid cuff comprises a pair of downwardly extending lateral wings which are pivotally connected to said rigid lower shell.

4. The boot structure of claim 2 wherein said rigid lower shell comprises a toe cup, a heel cup, a sole, and lateral side walls extending upwardly from said sole, and wherein said rigid lower shell is open at the foot instep region for allowing said rigid cuff to be substantially freely pivotable rearwardly and forwardly with respect to said rigid lower shell during use of the boot structure.

5. The boot structure of claim 4 further comprising a frame connected below said rigid lower shell for supporting a ground engaging skating element.

6. The boot structure of claim 5 further comprising a braking element connected rearwardly to said rigid cuff.

7. A boot structure comprising:

a soft innerboot for surrounding a user's foot and lower leg; and a rigid cuff connected to said innerboot for supporting a user's rear lower leg region and lateral lower leg regions;

said innerboot comprising:

a main portion extending for surrounding a user's sole, toes, heel, inner lateral foot, outer lateral foot, rear lower leg, inner lower leg, and outer lower leg;

a slit extending at least at the foot instep region of the innerboot for forming an inner flap and an outer flap of the innerboot adapted for being mutually spaced apart for permitting insertion and removal of a user's foot and lower leg respectively into and from the innerboot and further, adapted for being mutually releasably closed for securing a user's foot and lower leg inside the innerboot; and a tongue arranged between the inner and outer flaps adapted for supporting at least a user's foot instep region when said inner and outer flaps are mutually releasably closed;

said rigid cuff being rigidly connected to an upper portion of said main portion of the innerboot and extending for supporting essentially only the inner and outer lower leg and rear lower leg regions of a user, and said rigid cuff also having a slit in correspondence with the foot instep for permitting said inner and outer flaps of the innerboot together with lateral portions of said cuff to be moved between open and closed positions; and said rigid cuff being rigidly connected to said main portion of the innerboot such that said rigid cuff together with said upper portion of said main portion of the innerboot to which said rigid cuff is connected are mutually fixed in relative position to form a single upper portion element which is rigidly pivotable with respect to a lower portion of said main portion of the innerboot;

wherein said innerboot is made of an inner padding material and wherein the boot structure further comprises:

an outer covering connected to said inner padding material and externally covering said rigid cuff thereby said rigid cuff being embedded between said upper portion of said main portion of the innerboot and said outer covering; and a rigid lower shell arranged about the lower portion of said main portion of the innerboot for supporting a user's foot, said rigid cuff being pivoted to said rigid lower shell about an axis extending essentially through a user's malleolar regions, and said rigid lower shell being configured such that in use said rigid cuff is substantially freely pivotable rearwardly and forwardly with respect to said rigid lower shell.

8. A method of manufacturing a boot structure comprising the steps of:

providing a soft innerboot for surrounding a user's foot and lower leg such that said innerboot comprises: a main portion extending for surrounding a user's sole, toes, heel, inner lateral foot outer lateral foot, rear lower leg, inner lower leg, and outer lower leg; a slit extending at least at the foot instep region of the innerboot for forming an inner flap and an outer flap of the innerboot adapted for being mutually spaced apart for permitting insertion and removal of a user's foot and lower leg respectively into and from the innerboot and further adapted for being mutually releasably closed for securing a user's foot and lower leg inside the innerboot; and a tongue arranged between the inner and outer flaps adapted for supporting at least a user's foot instep region when said inner and outer flaps are mutually releasably closed;

providing a rigid cuff for supporting a user's rear lower leg region and lateral lower leg regions such that said rigid cuff extends for supporting essentially only the inner and outer lower leg and rear lower leg regions of a user, and such that said rigid cuff also has a slit in correspondence with the foot instep;

rigidly connecting said rigid cuff to an upper portion of said main portion of the innerboot such that said inner and outer flaps of the innerboot together with lateral portions of said cuff are permitted to be moved between open and closed positions, and such that said rigid cuff together with said upper portion of said main portion of the innerboot to which said rigid cuff is connected are mutually fixed in relative position to form a single upper portion element which is rigidly pivotable with respect to a lower portion of said main portion of the innerboot;

the method comprising providing said innerboot as an inner padding material, and the method further comprising the step of connecting an outer covering to said inner padding material such that said outer covering externally covers said rigid cuff thereby said rigid cuff being embedded between said upper portion of said main portion of the innerboot and said outer covering.

9. The method of claim 8 further comprising the steps of providing a rigid lower shell and, after said step of connecting said rigid cuff to an upper portion of said main portion of the innerboot, of arranging said rigid lower shell about the lower portion of said main portion of the innerboot for supporting a user's foot, and further of pivoting said rigid cuff to said rigid lower shell about an axis extending essentially through a user's malleolar regions, wherein said rigid lower shell being configured such that in use said rigid cuff is substantially freely pivotable rearwardly and forwardly with respect to said rigid lower shell.

10. The method of claim 9 further comprising providing said rigid cuff with a pair of downwardly extending lateral wings and pivotally connecting said wings to said rigid lower shell.

11. The method of claim 9 comprising providing said rigid lower shell with a toe cup, a heel cup, a sole, and lateral side walls extending upwardly from said sole, and such that said rigid lower shell is open at the foot instep region for allowing said rigid cuff to be substantially freely pivotable rearwardly and forwardly with respect to said rigid lower shell during use of the boot structure.

12. The method of claim 11 further comprising connecting a frame below said rigid lower shell for supporting a ground engaging skating element.

13. The method of claim 12 further comprising connecting a braking element rearwardly to said rigid cuff.

14. A method of manufacturing a boot structure comprising the steps of:

providing a soft innerboot for surrounding a user's foot and lower leg such that said innerboot comprises: a main portion extending for surrounding a user's sole, toes, heel, inner lateral foot, outer lateral foot, rear lower leg, inner lower leg, and outer lower leg, a slit extending at least at the foot instep region of the innerboot for forming an inner flap and an outer flap of the innerboot adapted to being mutually spaced apart for permitting insertion and removal of a user's foot and lower leg respectively into and from the innerboot and further adapted for being mutually releasably closed for securing a user's foot and lower leg inside the innerboot; and a tongue arranged between the inner and outer flaps adapted for supporting at least a user's foot instep region when said inner and outer flaps are mutually releasably closed;

providing a rigid cuff for supporting a user's rear lower leg region and lateral lower leg regions such that said rigid cuff extends for supporting essentially only the inner and outer lower leg and rear lower leg regions of a user, and such that said rigid cuff also has a slit in correspondence with the foot instep;

rigidly connecting said rigid cuff to an upper portion of said main portion of the innerboot such that said inner and outer flaps of the innerboot together with lateral portions of said cuff are permitted to be moved between open and closed positions, and such that said rigid cuff together with said upper portion of said main portion of the innerboot to which said rigid cuff is connected are mutually fixed in relative position to form a single upper portion element which is rigidly pivotable with respect to a lower portion of said main portion of the innerboot;

the method comprising providing said innerboot as an inner padding material, and the method further comprising the steps of:

connecting an outer covering to said inner padding material such that said outer covering externally covers said rigid cuff thereby said rigid cuff being embedded between said upper portion of said main portion of the innerboot and said outer covering;

providing a rigid lower shell; and successively arranging said rigid lower shell about the lower portion of said main portion of the innerboot for supporting a user's foot, and further pivoting said rigid cuff to said rigid lower shell about an axis extending essentially through a user's malleolar regions, wherein said rigid lower shell being configured such that in use said rigid cuff is substantially freely pivotable rearwardly and forwardly with respect to said rigid lower shell.

15. The method of claim 8 comprising connecting said rigid cuff to said upper portion of said main portion of the innerboot by stitching.

16. The method of claim 8 comprising connecting said rigid cuff to said upper portion of said main portion of the innerboot by gluing.

17. The method of claim 8 comprising connecting said rigid cuff to said upper portion of said main portion of the innerboot by molding in place.

* * * * *